US006240706B1

(12) United States Patent
Thomas et al.

(10) Patent No.: US 6,240,706 B1
(45) **Date of Patent: *Jun. 5, 2001**

(54) SEALING TOOL AND PROCESS FOR SEALING PACKAGES

(75) Inventors: Ulrich Thomas, Breidenbach-Oberdieten; Rolf Blöcher, Breidenbach, both of (DE); Celestino Inverardi, Corzano (IT)

(73) Assignee: Tiromat Krämer & Grebe GmbH & Co. KG, Biedenkopf-Wallou (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/318,152

(22) Filed: May 25, 1999

(30) Foreign Application Priority Data

Jun. 2, 1998 (DE) ..... 198 24 589

(51) Int. Cl.[7] ..... B65B 7/28

(52) U.S. Cl. ..... 53/329.3; 53/329; 53/559; 425/58; 425/483

(58) Field of Search ..... 53/329, 329.2, 53/329.3, 329.4, 329.5, 478, 453, 485, 559, 370.7, 430; 425/483, 58, 438

(56) References Cited

U.S. PATENT DOCUMENTS

| | | | | |
|---|---|---|---|---|
| 5,014,500 | * | 5/1991 | Robache | 53/559 |
| 5,241,801 | * | 9/1993 | Nelson | 53/313 |
| 5,307,610 | * | 5/1994 | Schneider et al. | 53/559 |
| 5,765,343 | * | 6/1998 | Whittaker | 53/430 |

FOREIGN PATENT DOCUMENTS

| | | |
|---|---|---|
| 59 503 | 11/1967 | (DE) . |
| 90 06 292 | 10/1990 | (DE) . |
| 195 41 983 A1 | 5/1997 | (DE) . |

* cited by examiner

*Primary Examiner*—Stephen F. Gerrity
*Assistant Examiner*—Sam Tawfik
(74) *Attorney, Agent, or Firm*—Akin, , Gump, Strauss, Hauer & Feld, L.L.P.

(57) ABSTRACT

The present invention relates to a sealing tool for sealing a package trough with a covering film, which tool consists of a bottom part, side parts oriented transversely and side parts oriented parallel to the direction of package trough feed, wherein at least one side part oriented parallel to the direction of feed is fixed in its spatial position in relation to the machine frame whereas the other parts of the matrix can be displaced vertically downwards.

9 Claims, 9 Drawing Sheets

SEALING TOOL AND PROCESS FOR SEALING PACKAGES

BACKGROUND OF THE INVENTION

The present invention relates to a sealing tool for sealing a package trough with a covering film.

Packages, particularly for foods, are becoming increasingly important today in making foods durable. For packaging, the foods are placed in a so-called package trough and the package trough is then closed gas-tight with a covering film by sealing the covering film onto the edge of the package trough.

SUMMARY OF THE INVENTION

As a rule, the package troughs are semicontinuously sealed with a covering film in so-called sealing stations. To this end, the package trough filled with the packaged product and the covering film are initially fed into the sealing station. As soon as the package trough is situated in the sealing station, a first bottom sealing tool is raised vertically from below and pressed against a second, heated top sealing tool located above the covering film. As a result of the pressure and temperature, the covering film and the edge of the package trough, which are situated between the sealing tools, are sealed. In order to obtain a gas-tight seal seam, it is important that the seal seam has a specific width and that the seal seam is essentially situated in the middle of the edge of the package trough. After sealing, the first sealing tool is lowered back beneath the freshly sealed package trough and the sealed package trough is fed on to the cutting station.

Although this type of sealing station has been in operation for several years, it nevertheless displays a number of disadvantages. For instance, package troughs with an undercut cannot be sealed with such a sealing tool because the first sealing tool collides with said undercut during lifting and lowering and destroys it. However, even on packages without an undercut, problems repeatedly occur during the sealing of heavily loaded package troughs because the package troughs sag. Because of this sag, the package troughs turn askew and the first sealing tool on its ascent collides with their corners and destroys or deforms them.

BACKGROUND OF THE INVENTION

The object is therefore to provide a device by means of which a package trough with an undercut can be sealed and which does not have the other disadvantages of the prior art.

According to the invention, said object is achieved by providing a bottom sealing tool for sealing a package trough with a covering film, which consists of a bottom part, side parts oriented transversely and side parts oriented parallel to the direction of package trough feed, wherein at least one side part oriented parallel to the direction of feed is fixed in its spatial position in relation to the machine frame whereas the other parts of the matrix can be displaced vertically downwards.

In the meaning of the invention, "fixed in its spatial position in relation to the machine frame" does not imply that the part must be in a totally rigid arrangement. In fact, it may move by several millimeters.

Both the side parts oriented parallel to the direction of feed are preferably fixed in their spatial position in relation to the machine frame.

In another preferred embodiment, the side parts remaining unchanged in their position in relation to the machine frame have on their top a surface with a low coefficient of friction.

This surface can be either polished or coated with Teflon or a similar material.

The side parts fixed in their spatial position preferably taper downwards so that package troughs having one or more undercuts oriented parallel to the direction of package feed can be sealed with said parts.

A sealing tool according to the invention is used preferably to seal at least two adjacent package troughs. In addition to the bottom part, the side parts oriented transversely, and the side parts oriented parallel to the direction of package trough feed, such a sealing tool also has preferably at least one middle part which is fixed in its spatial position in relation to the machine frame.

The side parts of such a sealing tool are also preferably fixed in their spatial position in relation to the machine frame.

In another preferred embodiment, the middle parts and the side parts remaining unchanged in their position in relation to the machine frame have on their top a surface with a low coefficient of friction. This surface can be either polished or coated with Teflon or a similar material.

The middle part and/or the side parts fixed in their spatial position preferably taper downwards so that package troughs having one or more undercut(s) oriented parallel to the direction of package feed can be sealed with said parts.

Another object of the present invention is to provide a process for sealing package troughs which does not have the disadvantages of the prior art.

According to the invention, said object is achieved by providing a process for sealing a package trough with a covering film using the sealing tool of the invention, wherein

- the covering film and the package trough are fed into the sealing station and optionally fixed and pressed between the bottom sealing tool and the top sealing tool, heated and thereby sealed,
- the vertically displaceable parts of the bottom sealing tool are lowered vertically, and
- the finished package is moved on.

The advantage of the present invention is that a package trough having one or more undercuts oriented parallel to the direction of package trough feed can be sealed with a covering film. Another advantage of the invention is that heavily loaded package troughs are supported by the side and/or middle part fixed in its spatial position and thus no longer sag, with the result that the sealing tool no longer destroys the package trough during its ascents and descents.

The invention will be illustrated in the following with reference to FIGS. 1 to 6. This is merely an explanation by way of example and thus does not limit the invention.

BRIEF DESCRIPTION OF THE DRAWINGS

FIG. 1*a* shows a package with undercuts. The package 1 consists of a package trough 2 and a covering film 3. The illustrated package is a so-called stand-up package which stands with its narrow side on the shown surface. The stand-up package has undercuts 5 in order to stabilize the package in its upright position.

FIG. 1*b* presents a top view of the package in FIG. 1*a*. The undercuts 5 are on one side of the package trough 2. The shaded area is the horizontal edge of the package trough onto which the covering film is sealed.

FIG. 2*a* shows the sealing tool 6 according to the invention for sealing a package trough with a covering film. The sealing tool has a bottom part 7, side parts 8, 9 oriented transversely and side parts 10, 11 oriented parallel to the direction of feed of the package troughs. The arrow shows the direction of feed of the sealed package troughs. The side part 11 is thicker at the top than at the bottom in order that package troughs with an undercut on the side facing the side part 11 can be sealed with this sealing tool. If a package trough with two undercuts is to be sealed, the side part 10 can also be designed in the same way as the side part 11.

FIG. 2*b* illustrates the sealing tool of FIG. 2*a* after lowering. After sealing, the parts 7, 8, 9, 10 of the sealing tool are lowered whereas the side part 11 remains fixed in its spatial position so that the undercut facing the side part 11 is not damaged. The sealed package trough can be fed on in the direction of the illustrated arrow, parallel to the side part 11, without damage being caused to the undercut.

FIG. 3*a* shows a sealing tool according to the invention for sealing two package troughs with covering films. In addition to the bottom part 12, the side parts 13, 14 oriented transversely and side parts 15, 16 oriented parallel to the direction of package trough feed, this matrix has the middle parts 17, 17*a*. The middle part 17 tapers downwards on both sides in such a way that this sealing tool allows to seal package troughs having undercuts facing the middle part 17, 17*a*. The middle part 17*a* has a constant cross section. A person skilled in the art immediately recognizes that the middle parts 17, 17*a* can also be produced as a single part. A person skilled in the art also recognizes that the middle part can also have a constant cross section overall. In this case, packages having an undercut cannot be sealed. The middle part then merely serves to support the film between the package troughs so that the film does not sag. Of course, the side parts 15 and 16 can also taper downwards so that it is possible with this sealing tool to seal package troughs with undercuts facing the side parts 15, 16.

FIG. 3*b* shows the sealing tool in FIG. 3*a* after lowering. After sealing, the parts 12, 13, 14, 15, 16, and 17*a* of the sealing tool are lowered whereas the side part 17 is not lowered but remains fixed in its spatial position so that the undercuts facing the middle parts 17 and 17*a* are not damaged. The sealed package troughs can be fed on in the direction of the illustrated arrow, parallel to the middle part 17, without damage being caused to the undercuts of the package troughs.

FIG. 4 shows a section of the sealing tool according to the invention, wherein the bottom part and the side parts oriented transversely to the direction of package trough feed have been lowered whereas the side parts 15, 16 and the two middle parts 17 are fixed in their spatial positions. The package troughs 19, 20, 21 are supported in particular from below by the middle parts 17 so that they do not sag.

FIG. 5 shows the sealing tool according to the invention for sealing two package troughs with the associated lowering mechanism. Of the sealing tool, the bottom part 24 and the side parts 25 and 26 oriented transversely to the direction of package trough feed are visible. The middle part of the sealing tool, consisting of two parts 22 and 23, is also visible. Whereas the part 22 has a constant cross section, the part 23 tapers downwards so that package troughs with an undercut can be sealed with the middle part. The part 23 is screwed onto the part 22 so that the shape of the undercut can be modified without major assembly effort. The middle part is fastened to a rod 28, which in turn is permanently connected to the machine frame (not illustrated) so that the middle part as a whole is fixed in its spatial position in relation to the machine frame. The bottom part of the sealing tool 24 is mounted on a plate 29 which has a drive (not illustrated) moving it vertically up and down, as indicated by the double-ended arrow. The plate 29 has a boring through which the rod 28 is guided.

If the side parts oriented parallel to the direction of feed are also to be fixed in their position in relation to the machine frame, they are likewise held with rods. A person skilled in the art will recognize that the middle part can also be fixed in any other way.

Figure 1A:
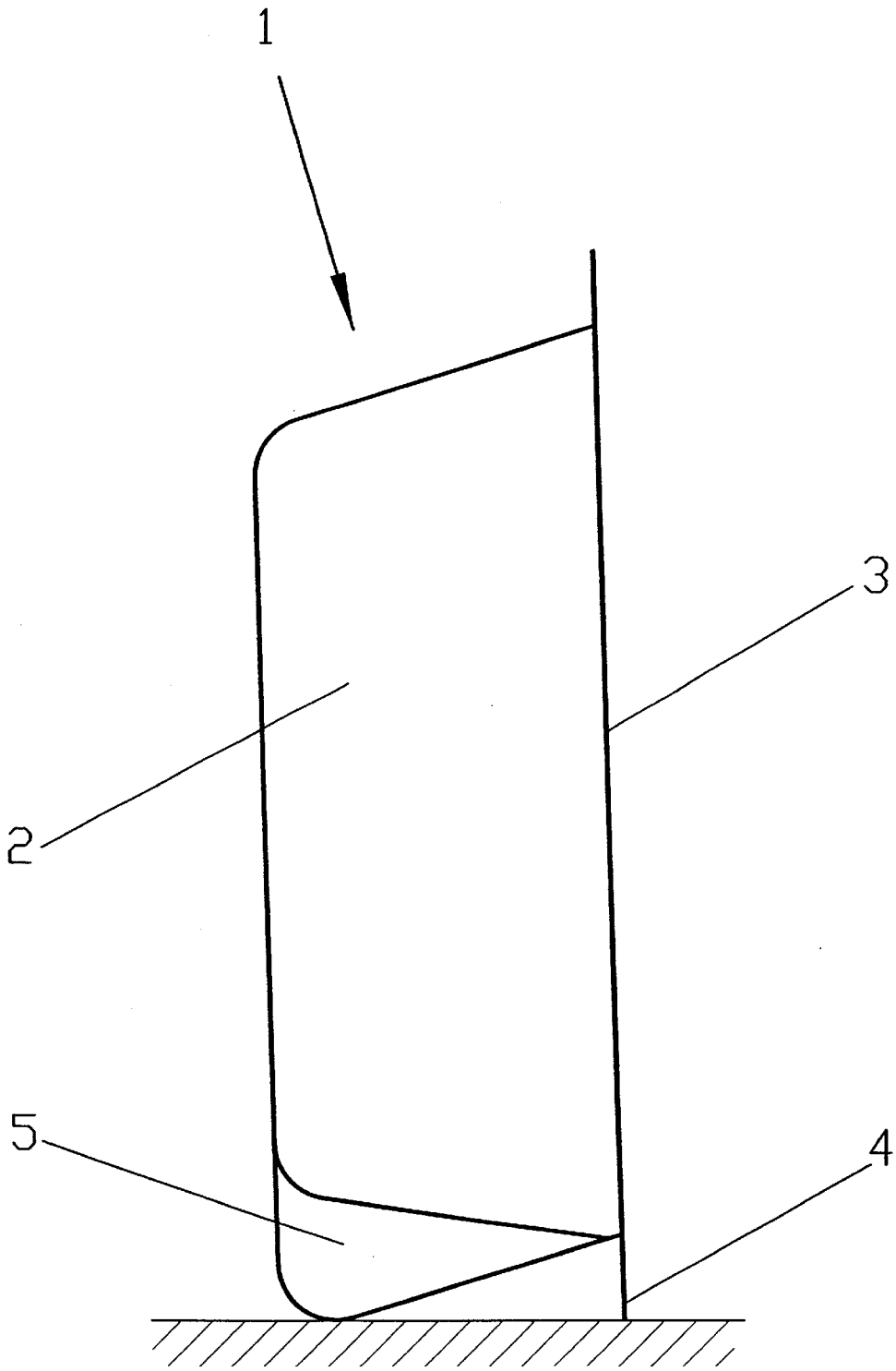
FIGS. 1*a* and 1*b* show a package with an undercut.
Figure 1B:
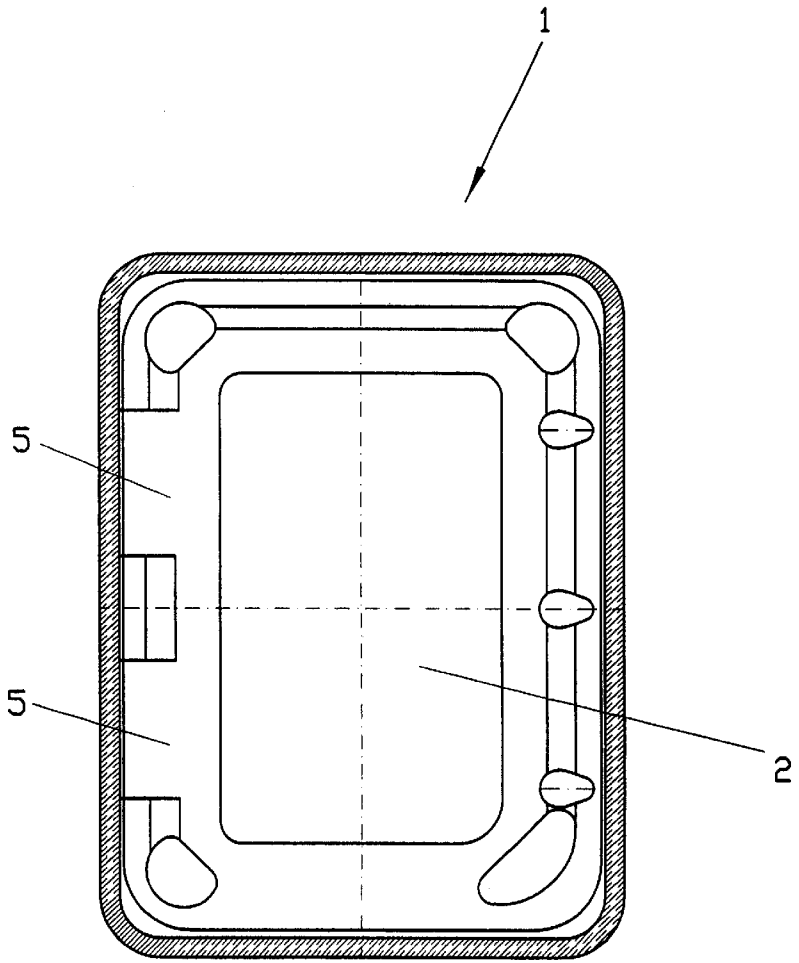
Figure 2A:
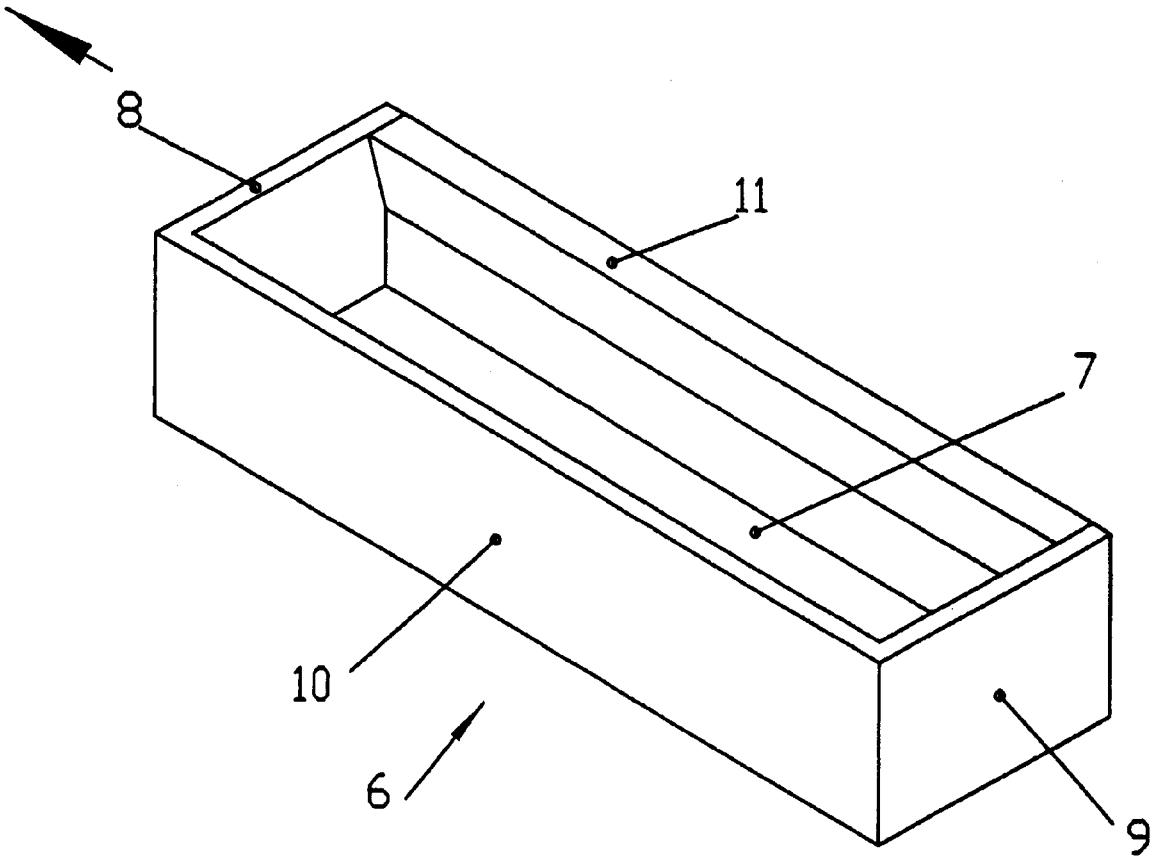
FIGS. 2*a* and 2*b* show a sealing tool according to the invention for sealing a package trough with a covering film.
Figure 2B:
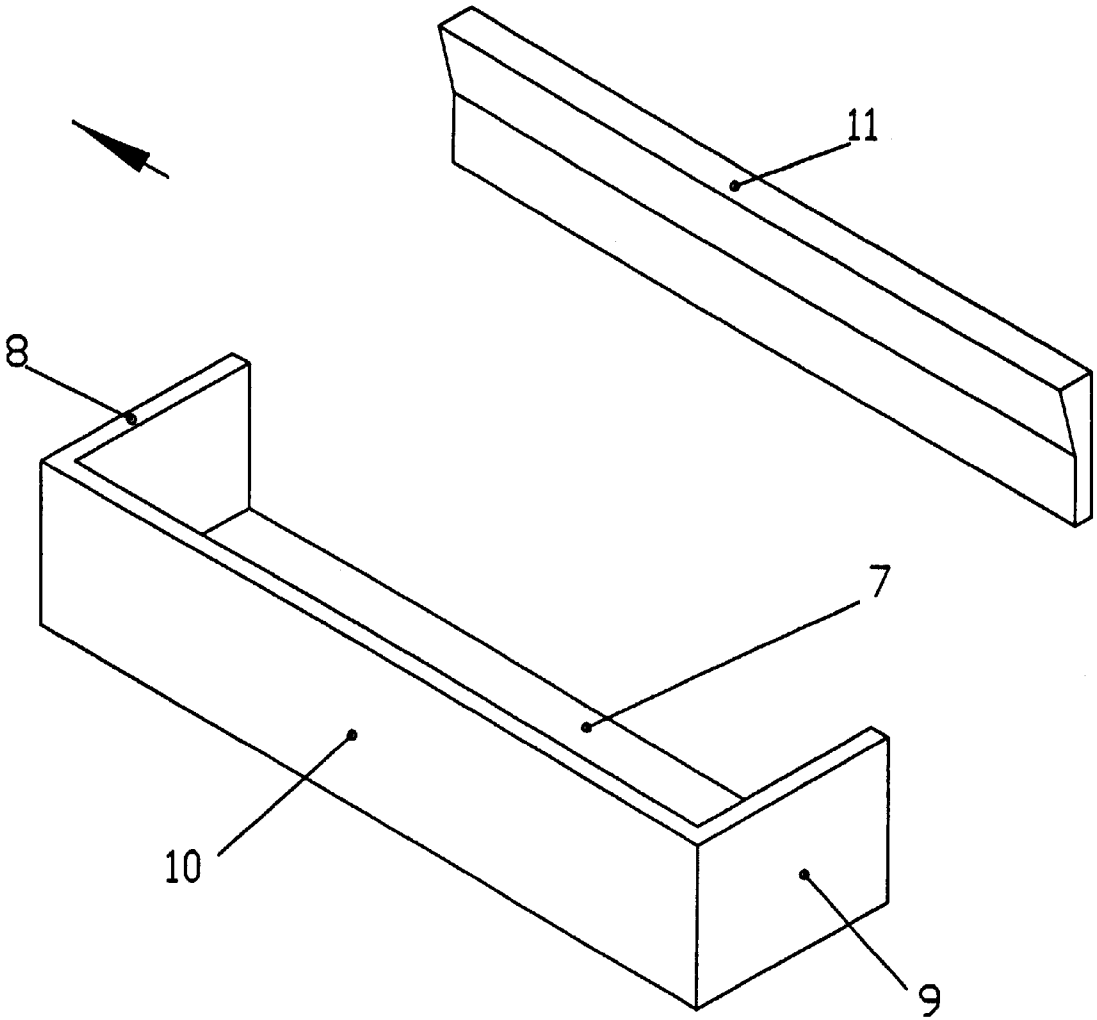
Figure 3A:
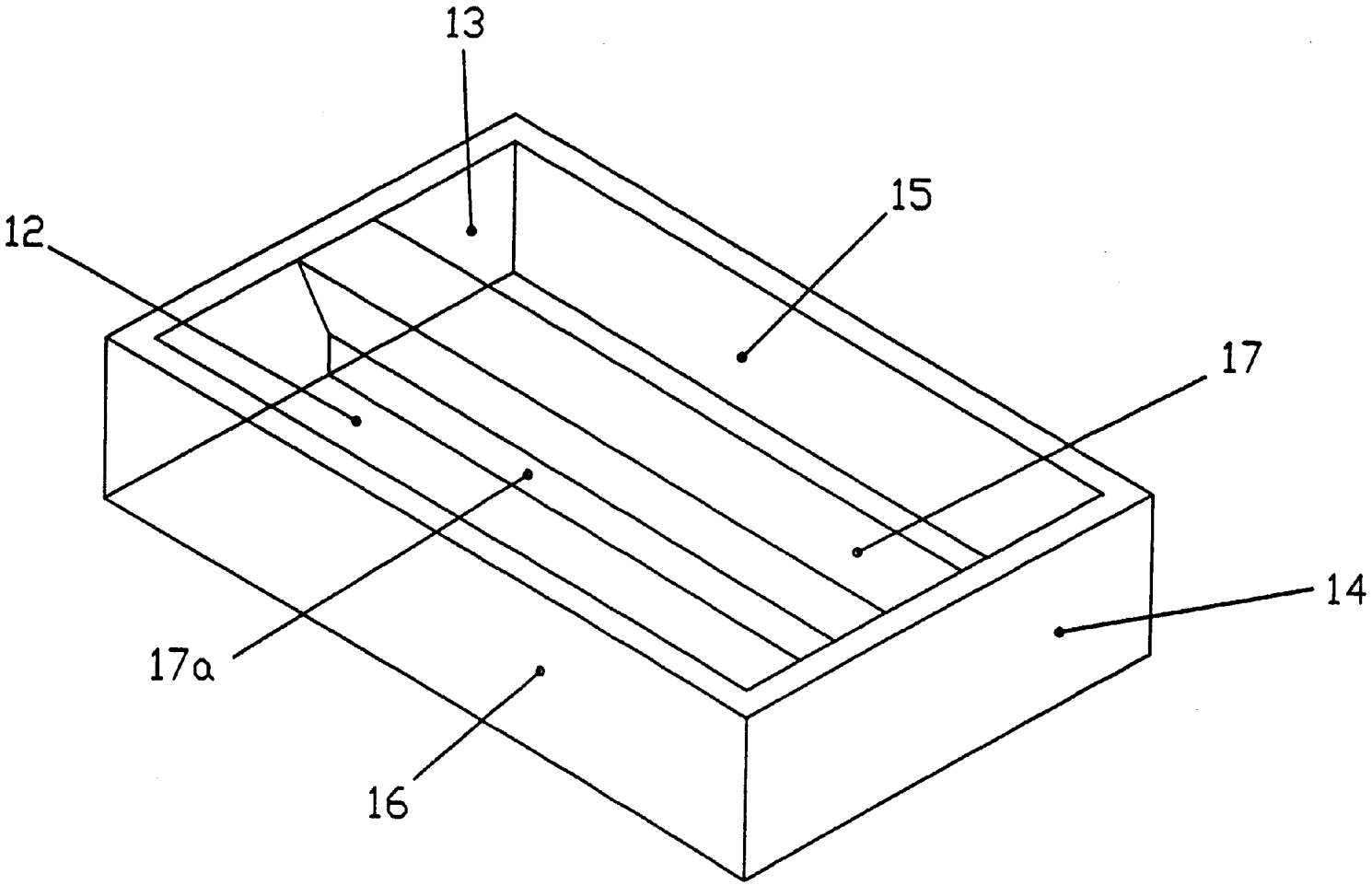
FIGS. 3*a* and 3*b* show a sealing tool according to the invention for sealing two package troughs with a covering film.
Figure 3B:
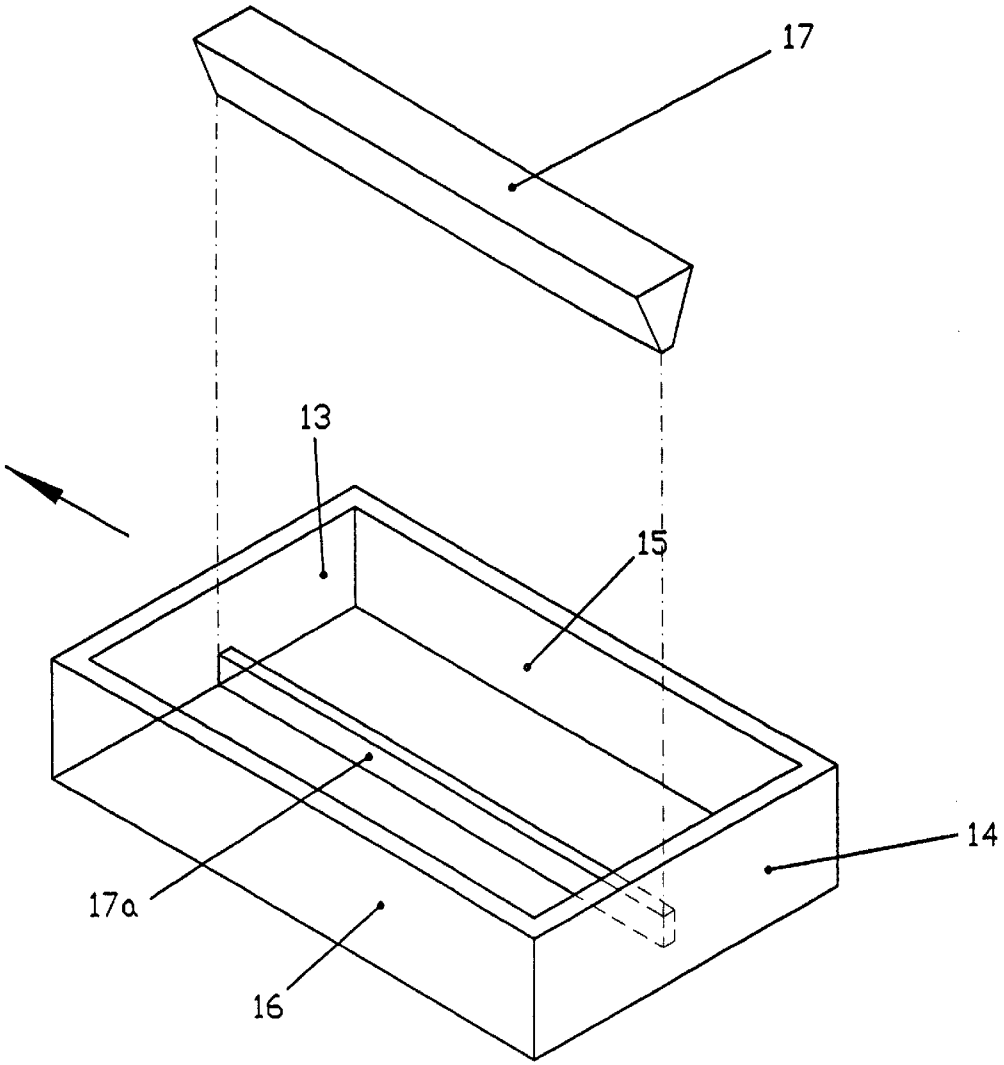
Figure 4:
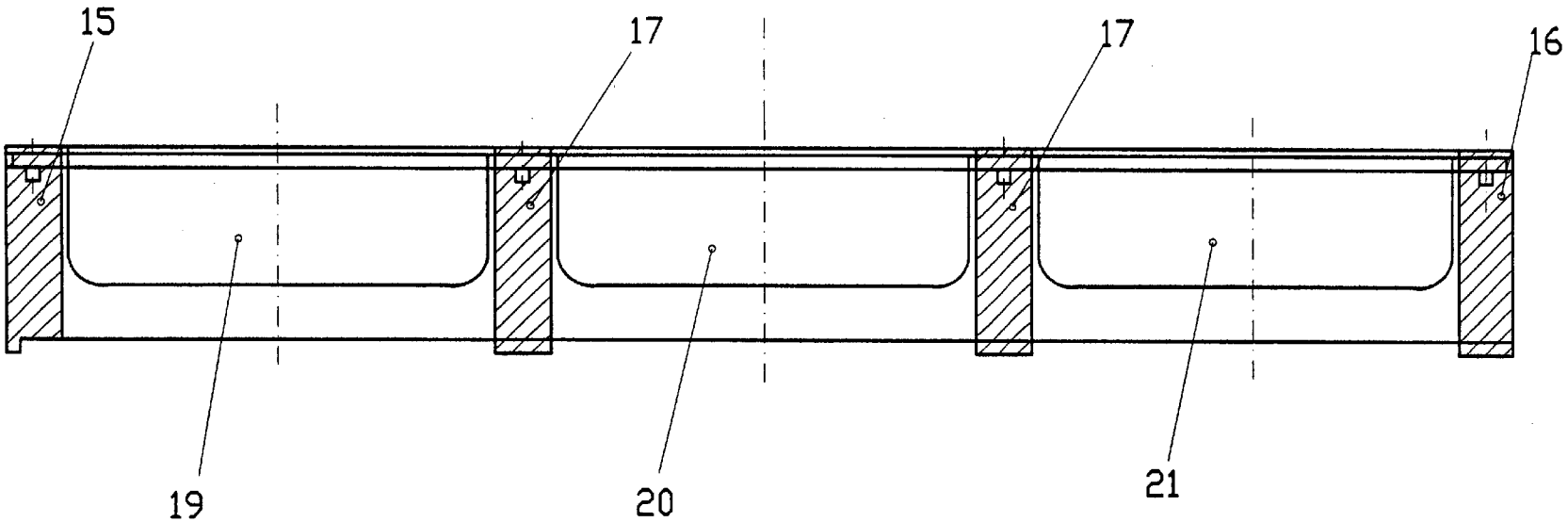
FIG. 4 shows a cross section of the sealing tool according to the invention for sealing three package troughs.
Figure 5:
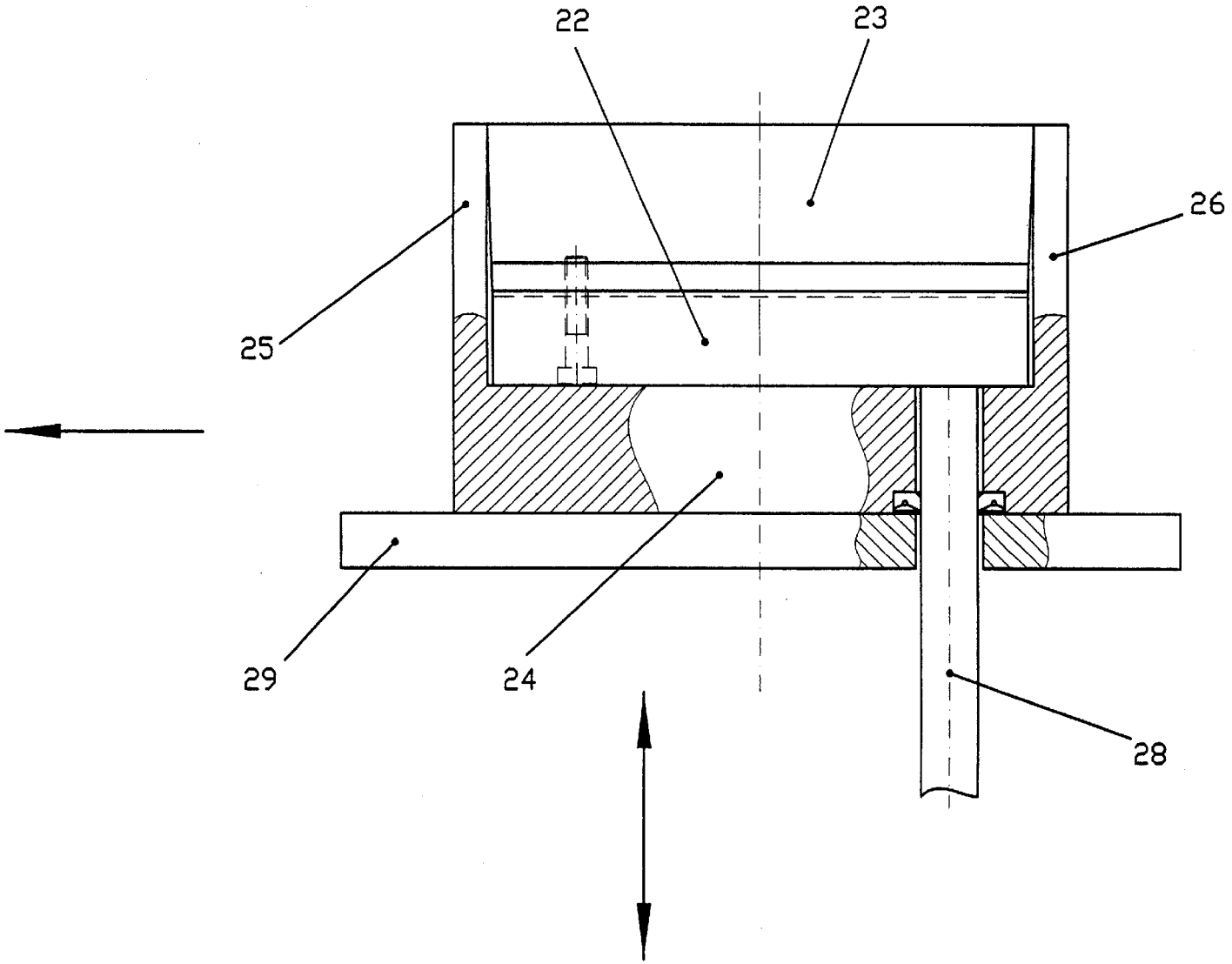
FIG. 5 shows the lowering mechanism for the sealing tool.
Figure 6:
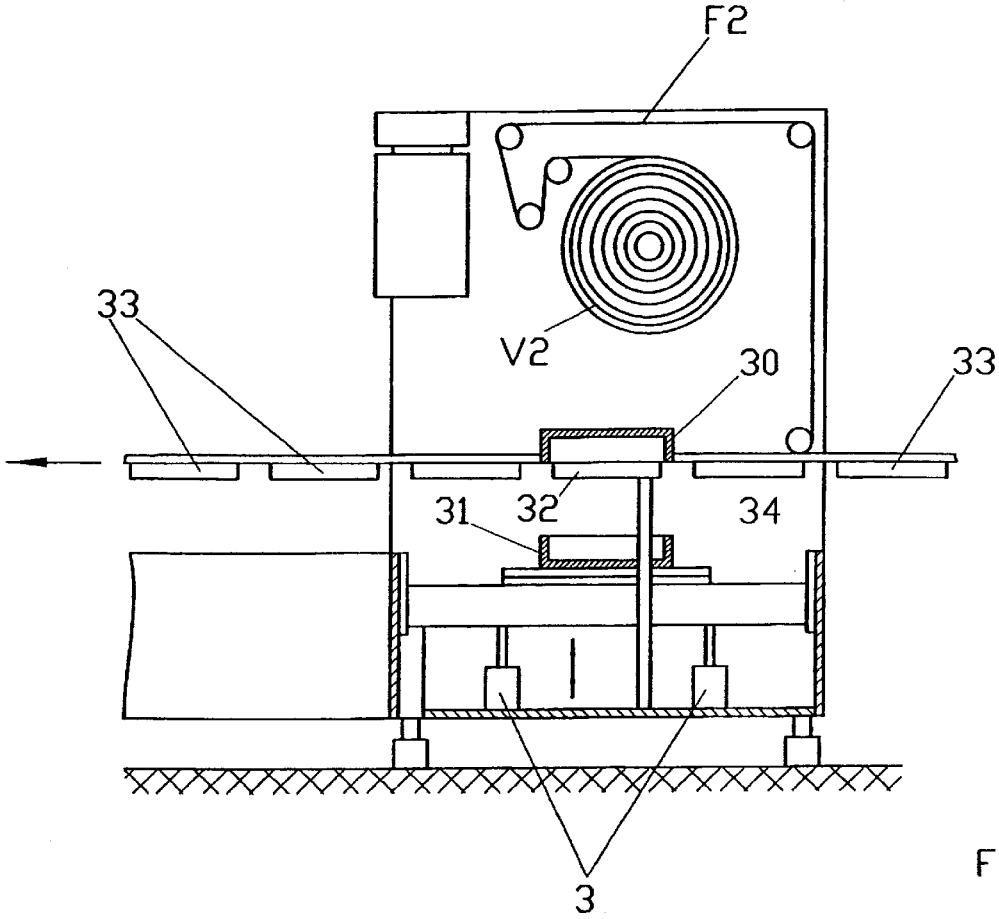
FIG. 6 shows a sealing station with the sealing tool according to the invention.

FIG. 6 shows a sealing station including the sealing tool of the invention. The package troughs 33, filled with packaged product, and the covering film F2, which is unrolled from the roll V2, are fed into the sealing station and fixed there. As soon as the package trough and the covering film are fixed, the lowered parts 31 of the sealing tool according to the invention are pressed against the heated top sealing tool 30. The covering film and the edge of the package trough, which are situated between the sealing tool 31, 32 according to the invention and the sealing tool 30, are heated and thus sealed. After sealing, the vertically displaceable parts 31 of the sealing tool are lowered again by the drives 35. The position of the middle part 32 is spatially fixed with a rod 34. After lowering the vertically displaceable parts 31 of the sealing tool, the film and thus the freshly sealed package troughs 33 are fed on to the cutting station and subsequently, the vertically displaceable parts of the sealing tool are raised again and the process of sealing the package trough can be repeated.

We claim:

1. A bottom sealing tool (6) for sealing a package trough with a covering film is operably attached to a machine frame and adapted to engage a top sealing tool, the bottom sealing tool comprising: a bottom part (7), a first plurality of side parts (8, 9) disposed on the bottom part and oriented transversely to a direction of package trough feed, and a second plurality of side parts (10, 11) oriented parallel to the direction of package trough feed and disposed on the bottom part (7), at least one of the second plurality of side parts being removably disposed on the bottom part and being capable of being maintained in position relative to the machine frame after the package trough has been sealed while the first plurality of side parts and any remaining second plurality of side parts of the bottom scaling tool (6, 31) can be displaced vertically downwards relative to the machine frame.

2. The bottom sealing tool according to claim 1 wherein the second plurality of side parts (10, 11) are removably disposed on the bottom part and are capable of being maintained in position relative to the machine frame after the package trough has been sealed while the first plurality of side parts can be displaced vertically downwards relative to the machine frame.

3. The bottom sealing tool according to claim 2 wherein the second plurality of side parts (10, 11) has a low-friction surface oriented toward the top sealing tool.

4. The bottom sealing tool according to claim 1 wherein a lateral side of at least one of the second plurality of side parts (10, 11) is tapered.

5. A bottom sealing tool capable of engaging a top sealing tool for sealing a package trough with a covering film, the bottom sealing tool being operably connected to a machine frame and comprising: a bottom part (12), a first plurality of side parts (13, 14) disposed on the bottom part and oriented transversely relative to a direction of package trough feed, a second plurality of side parts (15, 16) disposed on the bottom part and oriented parallel to the direction of package trough feed, and at least one middle part (17) removably disposed on the bottom part and capable of being maintained in position relative to the machine frame after the sealing of the package trough while a remaining portion of the bottom sealing tool is movable vertically downwards with respect to the machine frame.

6. The bottom sealing tool according to claim 5 wherein at least one of the second plurality of side parts is removably disposed on the bottom part and capable of being maintained in position relative to the machine frame after the sealing of the package trough while the remaining portion of the bottom sealing tool is movable vertically downwards with respect to the machine frame.

7. The bottom sealing tool according to claim 6 wherein at least one of the second plurality of side parts has a tapered lateral side.

8. The bottom sealing tool according to claim 5 wherein the at least one middle part has a plurality of tapered lateral sides.

9. The bottom sealing tool according to claim 5 wherein the at least one middle part has a low friction surface oriented to engage the package trough.

* * * * *